US006883344B2

(12) United States Patent
Gu

(10) Patent No.: US 6,883,344 B2
(45) Date of Patent: Apr. 26, 2005

(54) AIR-CONDITIONER WITH BOTH COOLING AND WARMING FUNCTIONS

(76) Inventor: Chujun Gu, 17th Floor, Taifenghuizhong Plaza, 120 Zhushikou West Street, Beijing, Xuanwu District (CN), 100050

( * ) Notice: Subject to any disclaimer, the term of this patent is extended or adjusted under 35 U.S.C. 154(b) by 0 days.

(21) Appl. No.: 10/898,551

(22) Filed: Jul. 26, 2004

(65) Prior Publication Data

US 2005/0011215 A1 Jan. 20, 2005

Related U.S. Application Data

(63) Continuation-in-part of application No. PCT/CN02/00446, filed on Jun. 26, 2002.

(30) Foreign Application Priority Data

Jan. 24, 2002 (CN) ..... 02100098 A

(51) Int. Cl.[7] ..... F25B 13/00

(52) U.S. Cl. ..... 62/324.1; 62/324.6; 62/238.6; 165/62

(58) Field of Search ..... 62/324.6, 324.1, 62/238.7, 238.6, 199; 165/62, 65

(56) References Cited

U.S. PATENT DOCUMENTS 4,506,521 A * 3/1985 Asano et al. ..... 62/238.7
5,526,650 A * 6/1996 Iritani et al. ..... 62/205
5,735,135 A * 4/1998 Katsuki et al. ..... 62/259.1

FOREIGN PATENT DOCUMENTS

| | | |
|---|---|---|
| CN | 2113442 U | 8/1992 |
| CN | 2268881 Y | 11/1997 |
| CN | 2278183 Y | 4/1998 |
| CN | 2306470 Y | 2/1999 |
| CN | 2425329 Y | 3/2001 |

* cited by examiner

*Primary Examiner*—Melvin Jones
(74) *Attorney, Agent, or Firm*—Liniak, Berenato & White

(57) ABSTRACT

The invention relates to a novel structured air-conditioner with both cooling and warming functions, comprising a compressor, an out-door heat exchanger, an in-door heat exchanger and a four-way change-over valve, characterized in that it further comprises a parallel capillary device, a parallel expansion valve device or a combination of parallel capillary and expanding valve connected with the in-door and the out-door heat exchanger respectively. Said parallel capillary device, said parallel expansion valve device or the combination comprises a two-position three-way change-over valve or one-way valve with opposite direction of leading through and two groups of parallel capillary tube, two groups of parallel expanding valve, parallel capillary tube and expanding valve or a combination of two groups of series capillary tube and expansion valve. The invention provides a new generation of air-conditioner with both cooling and warming functions having novel structure, excellent performance, low energy consume and high efficiency.

13 Claims, 3 Drawing Sheets

AIR-CONDITIONER WITH BOTH COOLING AND WARMING FUNCTIONS

This application is a Continuation-In-Part of International Patent Application No. PCT/CN02/00446 filed Jun. 26, 2002 which claims the benefits of Chinese Patent Application No. 02100098.0 filed Jan. 24, 2002.

FIELD OF INVENTION

The invention relates to air-conditioner with both cooling and warming functions (or referring to cooling and warming air-conditioner hereafter).

BACKGROUND OF INVENTION

At present the throttle device of air-conditioner with both cooling and warming functions can be divided mainly into both capillary throttle device and expansion valve throttle device. Generally, the capillary throttle device comprises a (or a group of) capillary tube, or a (or a group of) capillary tube connecting in series with another (or a group of) capillary tube connected with a one-way valve in parallel. The former is always throttled by same capillary tube under cooling operation mode and warming operation mode, so that the air-conditioner could not be operated at an optimum condition under above two modes i.e. a cooling and a warming operation mode. Furthermore, it is difficult to give consideration to the two different modes simultaneously for the optimized design of air conditioner. Although the latter can use capillary tubes of different length to throttle for both cooling operation mode and warming operation mode by adjustment and control of one-way valve, it is inconvenient to perform independent optimized design for cooling and warming operation modes of the air-conditioner respectively, because these two (or two groups of) capillary tubes are connected to each other in series. Similarly, the expanding valve throttle device has same problem, i.e. it is difficult to give consideration to two different operation modes simultaneously for optimized design of air-conditioner.

DISCLOSURE OF THE INVENTION

The object of the invention is to overcome the above mentioned shortcoming to provide an air-conditioner with both cooling and warming functions which is of novel structure, excellent performance, and low energy consume.

In order to achieve above object of the invention, the invention provides an air-conditioner with both cooling and warming functions, comprising a compressor, an out-door heat exchanger, an in-door heat exchanger, a four-way change-over valve and a parallel capillary device, wherein the parallel capillary device is connected with the in-door and the out-door heat exchanger, characterized in that said parallel capillary device comprises a combination of a two-position three-way electromagnetic valve or two one-way valves with opposite leading direction and two group of parallel capillary tubes, in the case of providing with two one-way valves with opposite leading direction, one end of one-way valves being directly connected with said out-door heat exchanger respectively, while the other ends of said one-way valve being connected with said two group of parallel capillary tubes respectively; in the case of providing with two-position three-way electromagnetic valve, one end of the electromagnetic valve the direction, of which the direction of inlet and outlet could be changed, being connected with the out-door heat exchanger directly, while the other two ends of three-way electromagnetic valve being connected with said two groups of capillary tubes respectively.

Said parallel capillary tube may comprise one or more capillary tubes connected in series and having different size and structure respectively. Thermal engineering devices, such as gas-liquid separator, oil-liquid separator, could be connected in series between respective series capillary tubes, and the size and structure of capillary tube may be selected according to the different type of air-conditioner. In cooling or warming operation mode, different capillary tube could be selected to throttle according to adopted two-position three-way change over valve or one-way valve in different communication-obstruction condition respectively.

In order to achieve above object of the invention, the invention further provides an air-conditioner with both cooling and warming functions, comprising a compressor, an out-door heat exchanger, an in-door heat exchanger, a four-way change-over valve and a parallel expanding valve device, wherein the parallel expanding valve device is connected with the in-door and the out-door heat exchanger, characterized in that said parallel valve expanding device comprises a combination of a two-position three-way electromagnetic valve or two one-way valves with opposite leading direction and two groups of parallel expansion valve devices, in the case of providing with two one-way valves with opposite leading direction, one end of one-way valves being connected directly with said out-door heat exchanger respectively, while the other ends of the one-way valves being connected respectively with said two groups of parallel expansion valves, in the case of providing with two-position three-way electromagnetic valve, one end of the two-position three-way electromagnetic valve, of which the direction of inlet and outlet could be changed, being connected with the out-door heat exchanger directly, while the other two ends of the three-way electromagnetic valve being connected respectively with two groups of parallel expansion valves.

The expanding valve could be same or different, and thermal engineering devices, such as gas-liquid separator, oil-liquid separator, could be connected in series between respective series expanding valves. The type of expanding valve may be selected according to different type of air-conditioner with both cooling and warming functions. In cooling or warming operation mode, different expanding valve could be selected to throttle according to adopted two-position three-way change over valve or one-way valve in different communication-obstruction condition respectively. All kinds of expanding valve being available in the market could be adopted.

In order to achieve above object of the invention, the invention provides an air-conditioner with both cooling and warming functions, comprising a compressor, an out-door heat exchanger, an in-door heat exchanger, a four-way change-over valve and a combination of parallel capillary tube and expansion valve, wherein the combination of parallel capillary tube and expanding valve is connected with in-door and out-door heat exchanger, characterized in that said device combination of parallel capillary tube and expansion valve comprises a two-position three-way electromagnetic valve or two one-way valves with opposite direction of leading through and the combination of a group of parallel capillary tube and a group of expanding valve, in the case of providing with two one-way valves with opposite direction of leading through, one end of one-way valves being connected directly with said out-door heat exchanger respectively, while the other ends of the one-way valves being connected with a group of parallel capillary tube and a group of expanding valve respectively, in the case of providing with two-position three-way electromagnetic valve, one end of two-position three-way electromagnetic valve, of which the direction of inlet and outlet could be changed being connected with said out-door heat exchanger directly, while the other two ends of the three-way electromagnetic valve being connected with a group of parallel capillary tube and a group of expansion valve respectively.

In order to achieve above object of the invention, the invention provides an air-conditioner with both cooling and warming functions, comprising a compressor, an out-door heat exchanger, an in-door heat exchanger, a four-way change-over valve and a combination of parallel capillary tube and expansion valve, wherein the combination of parallel capillary tube and expanding valve is connected with the in-door and the out-door heat exchanger, characterized in that said combination of parallel capillary tube and expansion valve comprises a two-position three-way electromagnetic valve or two one-way valves with opposite direction of leading through and a combination of two groups of parallel series capillary tube and expansion valve, in case of providing with two one-way valves with opposite direction of leading through, one end of the one-way valves being connected directly with the out-door heat exchanger respectively, while the other ends of the one-way valve being connected with the combination of parallel two groups of series capillary tube and expansion valve, in case of providing with two-position three-way electromagnetic valve, one end of the electromagnetic valve, of which the direction of inlet and outlet could be changed being connected with the out-door heat exchanger directly, while the other two ends of three-way electromagnetic valve being connected with said combination of two groups of series capillary tube and expansion valve.

In the air-conditioner with both cooling and warming functions according to the invention, the number of capillary tube and expanding valve may be one or more.

A combination formed by one or a group of capillary tube(s) and one or a group of expanding valve(s) in parallel, or a combination formed by parallel two groups formed by one or more capillary tube(s) and one or more expansion valve(s) connected in series has the features of both capillary and expanding valve, so as to act a coordinate effect and has more excellent performance. Moreover, thermal engineering devices, such as gas-liquid separator, oil-liquid separator, could be connected in series between respective series capillary tubes or expanding valves. In cooling operation mode or warming operation mode, different combination of capillary tube and expanding valve could be selected to throttle according to adopted two-position three-way change over valve or one-way valve in different communication-obstruction condition respectively.

A novel air-conditioner with both cooling and warming functions according to the invention comprises a compressor, an out-door heat exchanger, an in-door heat exchanger and a four-way change-over valve, characterized in that it further comprises a parallel capillary device, a parallel expanding valve device or a combination of parallel capillary device and expanding valve, wherein the parallel capillary device, parallel the expanding valve device or the combination of parallel two groups of series capillary tube and expanding valve is connected respectively with the in-door and the out-door heat exchanger. Since the parallel capillary device, parallel the expanding valve device or the combination of parallel two groups of series capillary tube and expanding valve used in the air-conditioner with both cooling and warming functions according to the invention, under cooling operation mode and warming operation mode, one (or a group of) capillary tube(s), one (or a group of) expanding valve(s) or a combination of capillary tube and expanding valve is adopted individually to throttle, and the two (or two groups of) capillary tubes, the two (or two groups of) expanding valves or the combination of two capillary tubes and expanding valves connected in series work independently without interference each other. Therefore, the requirement of independent optimized design for cooling operation mode and warming operation mode of air-conditioner could be satisfied, so as to achieve the goal of excellent performance, reducing energy consume, increasing efficiency.

The throttle device of air-conditioner of the invention adopts above structural arrangement due to the two technical reasons as follows:

(1). The transformation of cooling operation mode and warming operation mode of air-conditioner or heat pump is achieved by changing over the direction of refrigerant flowing through condenser and vaporizer with a four-way change-over valve. Although in FIG. 1 the structure of the system for both cooling and warming operation modes is completely the same as to the principle, but the situation is not so when considering the practice structure. Since in-door machine and out-door machine of separation-mounted air-conditioner have to be connected by connecting pipes, and considering the pressure reduction in cooling operation mode in the practical design, the diameter of connecting pipe from the capillary tube to the in-door machine is smaller than the diameter of connecting pipe from the in-door machine returning to the compressor. Therefore, the circuit in cooling operation mode, through which refrigerant flows, is: exhaust port of compressor - - - four-way valve - - - out-door machine (condensing pipe) - - - capillary tube and one-way valve - - - connecting pipe with smaller diameter - - - in-door machine (vaporizer) - - - connecting pipe with larger diameter - - - four-way valve - - - aspiration port of compressor, while the circuit in warming operation mode, through which refrigerant flows, is: exhaust port of compressor - - - four-way valve - - - connecting pipe with larger diameter - - - in-door machine (condenser) - - - connecting pipe with smaller diameter - - - capillary tube and one-way valve - - - out-door machine (vaporizer) - - - four-way valve - - - aspiration port of compressor. There is pressure loss at the one-way valve and the connecting pipe of the system to act as supplemental throttling effort. To compare with reverse Carnot cycle, the throttling process of the system mainly occurs at the capillary tube, the one-way valve and the connecting pipe, which are equivalent to a multi-stage series throttle device.

The research based on the model and experimental of two-stage series throttle of heat isolation capillary tube shows that multi-stage series throttle device exists variety of flow lock. The inlet pressure of next stage throttle device is not the outlet pressure of prior stage throttle device, but is its back pressure, while the vaporizing pressure of the system is the back pressure of last stage capillary tube. As the diameter of capillary tube increasing, flow lock occurs at outlet of last stage capillary tube first and then disappears gradually, after that the flow lock moves to the outlet of prior stage capillary tube step by step, until it occurs at the outlet of first capillary tube. When the flow lock occurs at the outlet of second stage capillary tube, the next stage capillary tube could not act for adjusting flow. Due to above reasons, the throttle device of air-conditioner of the invention adopts the structural arrangement as mentioned above. When the system is working under warming operation mode, the order of throttle device is: connecting pipe with smaller diameter - - - capillary tube - - - one-way valve, flow lock occurs at the outlet of second stage capillary tube, and the next throttle device is one-way valve acting as supplemental throttling effort only. While the system is working under cooling operation mode, the order of throttle device is: one-way valve - - - capillary tube - - - connecting pipe with smaller diameter, flow lock occurs at the outlet of second capillary tube, and the next stage connecting pipe acts as supplemental throttling effort only. Therefore, vaporizing pressure and refrigerant flow could be adjusted by means of inner diameter and length of capillary tube to achieve optimized throttling effort, so as to achieve the best energy consuming effort.

(2). The invention adopts the order of structural arrangement, that is under cooling operation mode, one-way valve is connected with out-door heat exchanger directly, i.e. one-way valve is placed at high pressure side. The reason of this design arrangement is that since at high pressure side (i.e. refrigerant just flowing out of condenser is under high temperature and high pressure liquid state), the temperature of refrigerant is higher than the temperature of environment, and in this time refrigerant is still in the condition of radiating outside. Under this condition, the temperature of gas-liquid phase-change point of the cooling agent is higher, the role of core of one-way valve would not affect the flowing and phase-state of the refrigerant, and the stability of the state of refrigerant before entering capillary tube throttling is advantageous to raise efficiency of capillary throttling. On the contrary, if one-way valve is placed at downstream side of the throttling capillary, the state of refrigerant would be changed into liquid state with low temperature and low pressure due to throttling of capillary, at this time the temperature of refrigerant is lower than the temperature of environment, i.e. in heat-absorbing state, in which state, due to low pressure of gas-phase, the refrigerant is easy to absorb heat to cause phase-change. Moreover, the one-way valve is located at outlet of the capillary tube, the disturbance of the core of one-way valve would intensify the alternation of the state of refrigerant, and the refrigerant would be vaporized in advance. Furthermore, the one-way valve is connected with in-door heat exchanger through longer connecting pipe, so that the heat quantity absorbed by refrigerant enhances during flowing, the larger the absorbed heat quantity lowers the efficient utilization ratio of the refrigerant, and the phase-change of cooling agent in advance would enhance non-efficient loss of refrigerant, and would enhance the flowing resistance of refrigerant along path, thus reducing the work efficiency of the system. To avoid such a condition, the one-way valve should be connected with the out-door heat exchanger first and then connected with the capillary tube.

Under warming operation mode, one-way valve is placed at downstream side of the capillary tube and connected with out-door heat exchanger directly. The reason of this arrangement design is the different condition under warming operation mode, that is, warming operation mode always occurs at lower temperature of out-door of environment. Since lower temperature of the environment at warming operation mode, the thermal-conductive temperature difference between the environment and the heat exchanger is smaller, the heat flow density through the wall surface is lower, it is disadvantage for heat exchanging of cooling agent, cooling agent would maintain one-way flowing condition and lower heat exchanging efficiency in a certain long flowing process, at this time, disadvantage of smaller heat exchanging coefficient of single-phase flow could be changed by means of larger heat exchanging coefficient sufficiently of two-phase flow to expedite state of refrigerant from liquid phase to be transformed to gas-liquid phase, so as to raise thermal conductivity of inner side of heat exchanger, thus increasing efficient utilization ratio of heat exchanger, which would benefit heat exchanging. Therefore one-way valve is placed at outlet of capillary tube and connected with out-door heat exchanger directly, the disturbance of core of one-way valve would intensify the alternation of the state of refrigerant, on the one hand, to expedite refrigerant from liquid state to be changed to two-phase flow state, and on the other hand, by means of disturbance and mixture of one-way valve, to promote the even degree of refrigerant in distributor, and to increase uniformity of split-flow of refrigerant, so as to increase utilization ratio of heat exchanger. In addition, the disturbance of one-way valve further benefit to expedite vaporization and heat-absorption of refrigerant after throttling, and to expedite transform of refrigerant two-phase flow, so as to increase utilization ratio of out-door exchanger, and to enhance operational efficiency of the system.

For air-conditioner according to the invention, the compressor, the four-way change over valve, the in-door heat exchanger and the out-door heat exchanger have no strict requirement, they may be obtained from market, and selected according to different requirement of air-conditioner with both cooling and warming.

The invention provides a new generation cooling and warming air-conditioner having novel structure, excellent performance, low energy consume, high efficiency, and it can be applied to not only air-conditioner with both cooling and warming functions, but also other cooling equipment.

BEST MODE FOR CARRYING OUT THE INVENTION

The invention will be further described by means of following embodiments in conjunction with attached drawings. However, the protecting scope of the invention is not limited to the following embodiments, and the alternative and modification made by a person skilled in the art will be within the protecting scope.

Embodiment 1

Figure 1:
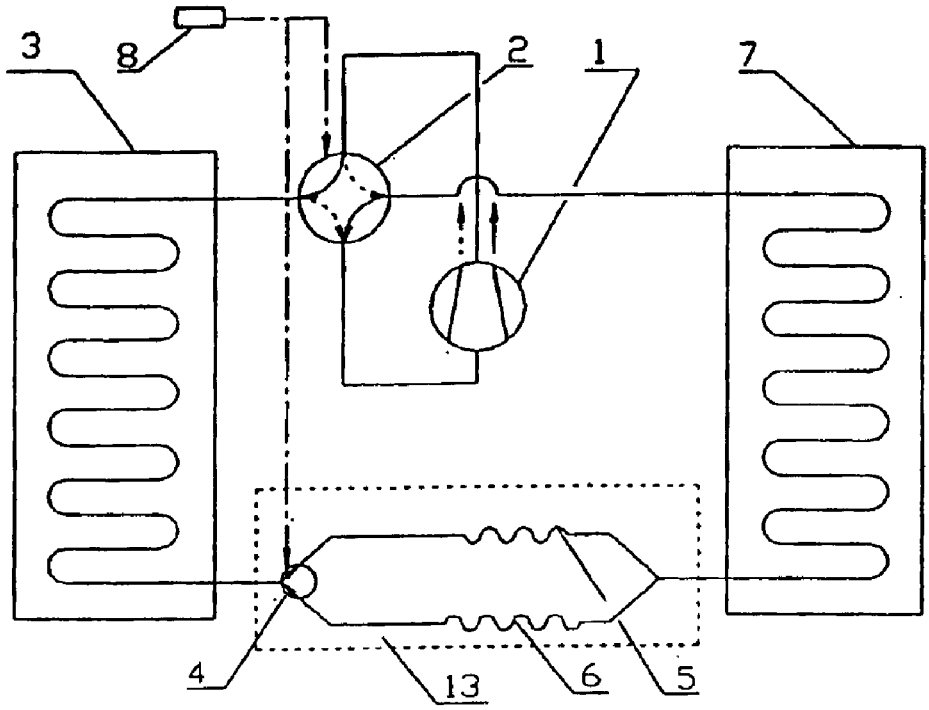
FIG. 1 is a schematic view of an embodiment of circulating system of cooling and warming air-conditioner provided with parallel capillary tube device.

Embodiment 1 is a circulating system of both cooling and warming air-conditioner having parallel capillary device comprising a two-position three-way electromagnetic valve and two groups of parallel capillary tube, as shown in FIG. 1. A compressor 1, a cooling-warming change-over switch 8, a four-way change-over valve 2, an out-door heat exchanger 3, a parallel capillary tube device 13 (including a two-position three-way electromagnetic valve 4, and a parallel capillary tube 5 for cooling operation mode and capillary tube 6 for warming operation mode), an in-door heat exchanger 7, connecting pipes and other auxiliary means form a cooling or a warming circulating system. The cooling-warming change-over switch 8 controls the valve position of the four-way change-over valve 2 and the two-position three-way electromagnetic valve 4. When a cooling operation mode is selected by the cooling-warming change-over switch 8, refrigerant flowed out from the compressor 1 flows to the out-door exchanger 3 through the four-way change over valve 2 to be condensed, the two-position three-way electromagnetic valve 4 selects the cooling condition capillary tube 5 to communicate, the refrigerant is vaporized to refrigerate in the in-door exchanger 7, and then returns to the compressor 1 through the four-way change-over valve 2. When a warming operation mode is selected by the cooling-warming change-over switch, refrigerant flowed out from compressor 1 flows to the in-door exchanger 7 through the four-way change-over valve to be condensed to warm, the two-position three-way electromagnetic valve 4 selects the capillary tube 6 for warming operation mode to communicate, the refrigerant is vaporized in out-door exchanger 3 and then returns to compressor 1 through four-way change-over valve 2. In FIG. 1, the solid line arrow indicates a cooling cycle, and the dot line arrow indicates a warming cycle.

Embodiment 2

Figure 2:
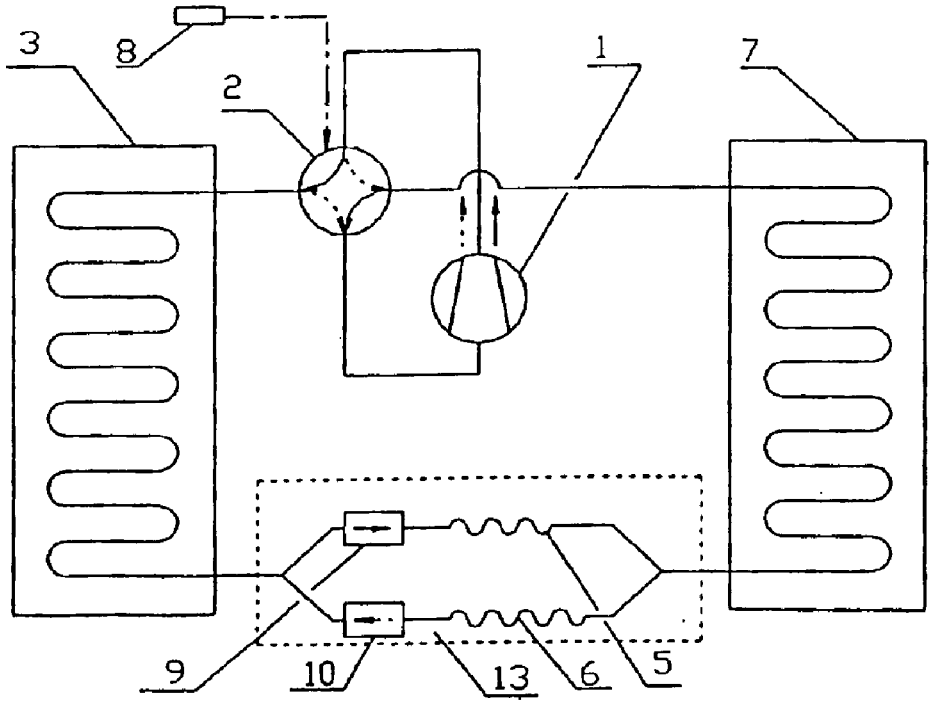
FIG. 2 is a schematic view of another embodiment of circulating system of cooling and warming air-conditioner provided with parallel capillary tube device.

Embodiment 2 is a circulating system of cooling and warming air-conditioner having parallel capillary tube device comprising two one-way valves and two groups of parallel capillary tube, as shown in FIG. 2. A compressor 1, a cooling-warming change-over switch 8, a four-way change-over valve 2, an out-door heat exchanger 3, a parallel capillary device 13 (including parallel series one-way valve 9 and capillary tube 5 for cooling operation mode, and series one-way valve 10 and capillary tube 6 for warming operation mode), an in-door heat exchanger 7 and connecting pipes and auxiliary means form a cooling or warming circulating system. The cooling- warming change-over switch 8 controls the valve position of the four-way change-over valve 2. Under cooling operation mode, the one-way valve 9 for cooling operation mode is opened to cause the capillary tube 5 for cooling operation mode to work, and the one-way valve 10 for warming operation mode is closed; under warming operation mode, the one-way valve 10 for warming operation mode is opened to cause the capillary tube 6 for warming operation mode to work, and the one-way valve 9 for cooling operation mode is closed. In FIG. 2, the solid line arrow indicates a cooling cycle, and the dot line arrow indicates a warming cycle.

Embodiment 3

Figure 3:
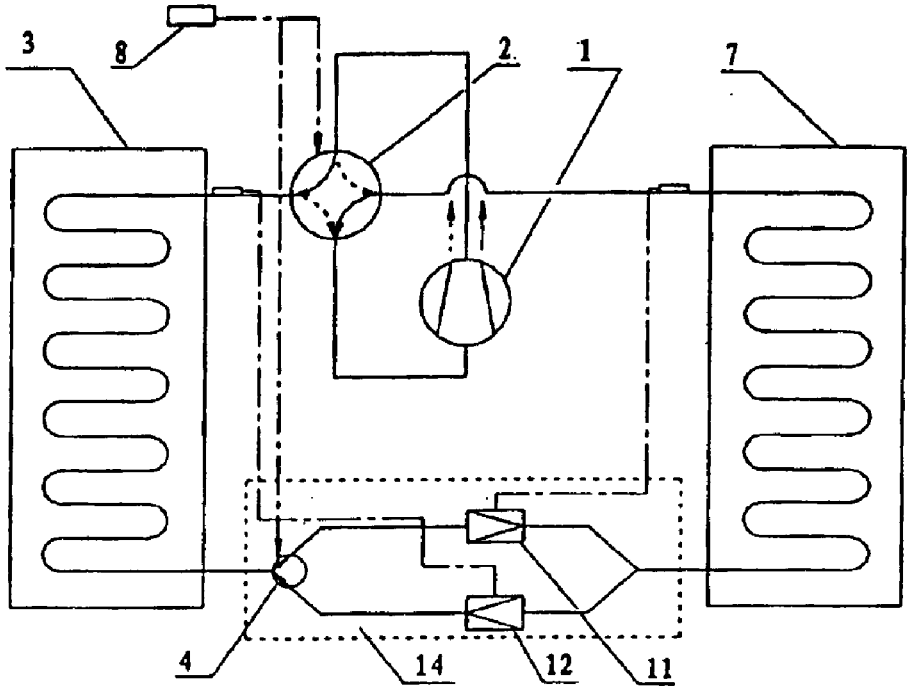
FIG. 3 is a schematic view of an embodiment of circulating system of cooling and warming air-conditioner provided with parallel expanding valve device.

Embodiment 3 is a circulating system of cooling and warming air-conditioner having parallel expansion valve device comprising a two-position three-way electromagnetic valve and two groups of parallel expansion valves, as shown in FIG. 3. A compressor 1, a cooling-warming change-over switch 8, a four-way change-over valve 2, an out-door heat exchanger 3, a parallel expansion valve device 14 (including a two-position three-way electromagnetic valve 4 and parallel expanding valve 11 for cooling operation mode and expansion valve 12 for warming operation mode), an in-door heat exchanger 7 and connecting pipes and other auxiliary means form a cooling or warming circular system. The cooling-warming change-over switch 8 controls the valve position of both the four-way change-over valve 2 and the two-position three-way electromagnetic valve 4. When cooling condition is selected by the cooling-warming change-over switch 8, refrigerant flowed out from the compressor 1 flows to the out-door heat exchanger 3 through the four-way change over valve 2 to be condensed, and the two-position three-way electromagnetic valve 4 selects the expanding valve 11 for cooling operation mode to communicate, the refrigerant is vaporized to refrigerate in the in-door heat exchanger 7 and then returns to compressor 1 through the four-way change-over valve 2. When a warming condition is selected by the cooling-warming change-over switch 8, refrigerant flowed out from the compressor 1 flows to the in-door heat exchanger 7 to be condensed to warm, and the two-position three-way electromagnetic valve 4 selects the expanding valve 12 to communicate, refrigerant is vaporized in the out-door heat exchanger 3 and then returns to the compressor 1 through the four-way change over valve 2. In FIG. 3, solid line arrow indicates a cooling cycle, and dot line arrow indicates a warming cycle.

Embodiment 4

Figure 4:
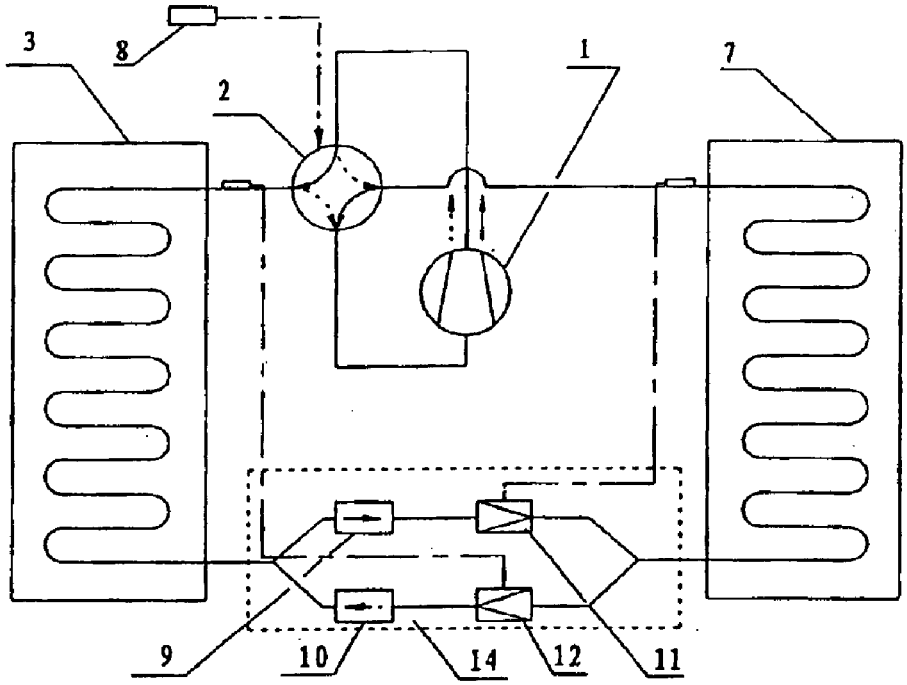
FIG. 4 is a schematic view of another embodiment circulating system of cooling and warming air-conditioner provided with parallel expansion valve device.

Embodiment 4 is a circulating system of cooling and warming air-conditioner having parallel expansion valve device comprising two one-way valves and two groups of parallel expansion valves, as shown in FIG. 4. A compressor 1, a cooling-warming change-over switch 8, a four-way change-over valve 2, an out-door heat exchanger 3, a parallel expansion valve device 14 (including parallel series one-way valve 9 and expansion valve 11 for cooling operation mode, and series one-way valve 10 and expansion valve 12 for warming operation condition), and an in-door heat exchanger 7, connecting pipes and other auxiliary means form a cooling or warming circular system. Under cooling operation mode, the one-way valve 9 for cooling operation mode is opened to cause the expansion valve 11 for cooling operation mode to work, and the one-way valve 10 for warming operation mode is closed; under warming operation mode, the one-way valve 10 for warming operation mode is opened to cause the one-way valve 12 for warming operation mode to work, while the one-way valve 9 for cooling operation mode is closed. In FIG. 4, solid line arrow indicates a cooling cycle, and dot line arrow indicates a warming cycle.

Embodiment 5

Figure 5:
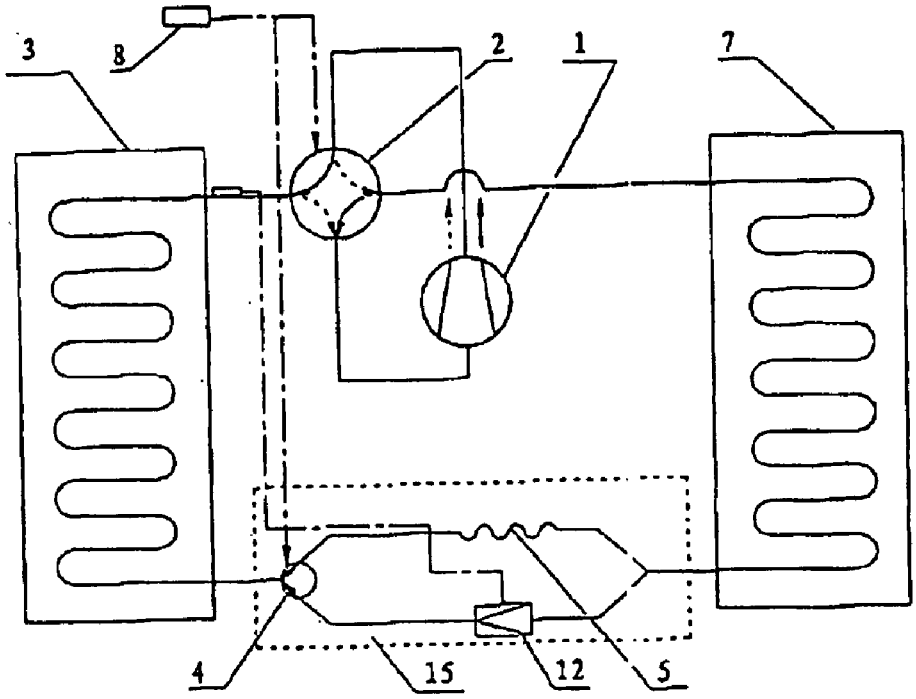
FIG. 5 is a schematic view of an embodiment of circulating system of cooling and warming air-conditioner provided with hybrid connected capillary tube and expansion valve device.

Embodiment 5 is a circulating system of cooling or warming circular system air-conditioner having a combination of parallel capillary tube and expansion valve comprising a two-position three-way electromagnetic valve 4 and parallel a group of parallel capillary tube and a group of expanding valve (as shown in FIG. 5). A compressor 1, a cooling-warming change-over switch 8, a four-way change-over valve 2, an out-door heat exchanger 3, a combination 15 of parallel capillary tube and expanding valve (a combination including a two-position three-way electromagnetic valve 4 and parallel capillary 5 for cooling operation mode and expansion valve 12 for warming), an in-door heat exchanger 7, connecting pipes and other auxiliary means form a cooling or warming circular system. The position of valve of the four-way change over valve 2 and the two-position three-way electromagnetic valve 4 is controlled by cooling-warming change-over valve 8. When cooling operation mode is selected by the cooling-warming change-over valve 8, refrigerant flowed out from the compressor 1 flows to the out-door heat exchanger 3 through the four-way change over valve 2 to be condensed, and the capillary 5 for cooling operation mode is selected by the two-position three-way electromagnetic valve 4 to communicate, refrigerant is vaporized in the in-door heat exchanger 7 and then returns to the compressor 1 through the four-way change over valve 2. When warming operation mode is selected by cooling-warming change-over switch 8, refrigerant flowed out from the compressor 1 flows to the in-door heat exchanger 7 through the four-way change-over valve to be condensed to warm, and the expansion valve 12 for warming operation mode is selected by the two-position three-way electromagnetic valve 4 to communicate, refrigerant is vaporized in the out-door heat exchanger 3 and then returns to the compressor 1 through four-way change-over valve 2.

In this embodiment, the combination of capillary tube 5 for cooling and expanding valve 12 for warming may be substituted by a combination of expanding valve 11 for cooling and capillary tube 6 for warming (not shown). Alternatively, the two-position three-way electromagnetic valve 4 may be substituted by combination of an one-way valve 9 for cooling operation mode and an one-way valve 10 for warming operation mode to connect with parallel capillary tube and expanding valve respectively (see FIG. 6).

Figure 6:
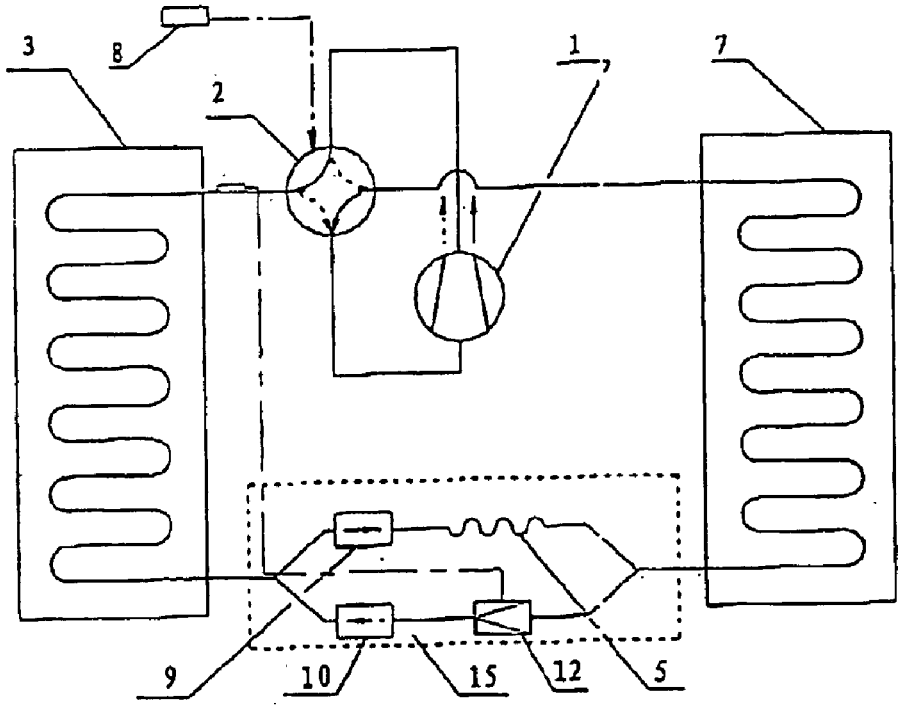
FIG. 6 is a schematic view of another embodiment of circulating system of cooling and warming air-conditioner provided with hybrid connected capillary tube and expansion valve device.

In FIGS. 5 and 6, solid line arrow indicates a cooling cycle, and dot line arrow indicates a warming cycle.

Embodiment 6

Embodiment 6 is a circular system (not shown) of cooling and warming air-conditioner having a combination of parallel capillary tube and expanding valve comprising a combination of two one-way valves and parallel two groups of series capillary tube and expanding valve. A compressor 1, a cooling and warming change over switch 8, a four-way change-over valve 2, an out-door heat exchanger 3, a combination comprising parallel two groups of series capillary tube and expansion valve (for example, including parallel a combination of series one-way valve 9 for cooling operation mode and capillary 5 as well as expanding valve 11 for cooling operation mode and a combination comprising series one-way valve 10 for warming operation mode and series expanding valve 12 and capillary tube 6 for warming operation mode), an in-door heat exchanger 7, connecting pipes and other auxiliary means form a cooling or warming cycle. The valve position of four-way change-over valve 2 is controlled by cooling-warming change-over switch 8. Under cooling operation mode, the one-way valve 9 for cooling operation mode is opened to cause the series capillary tube and expanding valve for cooling operating mode to work, and the one-way valve 10 for warming operation mode is closed; under warming condition, the warming condition one-way valve 10 is opened to cause series expanding valve and capillary tube for warming operation mode to work, while the one-way valve 9 for cooling operation mode is closed.

In this embodiment, the one-way valve for cooling operation mode and the one-way valve for warming operation mode may be substituted by a two-position three-way electromagnetic valve. Moreover, the number of capillary tube and expansion valve in the combination of capillary tube and expansion valve may be of one or more.

What is claimed is:

1. An air-conditioner with both cooling and warming functions, comprising a compressor (1), an out-door heat exchanger (3), an in-door heat exchanger (7), a four-way change-over valve (2) and a parallel capillary device (13), wherein the parallel capillary device (13) is connected with the in-door and the out-door heat exchanger (7, 3), characterized in that said parallel capillary device (13) comprises a combination of a two-position three-way electromagnetic valve (4) or two one-way valves (9, 10) with opposite direction of leading through and two group of parallel capillary tubes (5, 6), in the case of providing with two one-way valves (9, 10) with opposite direction of leading through, one end of one-way valves (9, 10) being directly connected with said out-door heat exchanger (3) respectively, while the other ends of said one-way valve (9, 10) being connected with said two group of parallel capillary tubes (5, 6) respectively; in the case of providing with two-position three-way electromagnetic valve, one end of the electromagnetic valve the direction of which the direction of inlet and outlet could be changed being connected with the out-door heat exchanger (3) directly, while the other two ends of three-way electromagnetic valve (4) being connected with said two groups of capillary tubes (5, 6) respectively.

2. The air-conditioner with both cooling and warming functions according to claim 1, wherein said two groups of capillary tubes in said parallel capillary tube device (13) include respectively at least one capillary tube having different size and structure.

3. The air-conditioner with both cooling and warming functions according to claim 1, wherein each capillary tube in said parallel capillary tube device (13) is formed by a plurality of capillary tubes connected in series.

4. The air-conditioner with both cooling and warming functions according to claim 3, wherein thermal engineering device such as gas-liquid separator, oil-liquid separator may be connected in series between respective series capillary tubes.

5. An air-conditioner with both cooling and warming functions, comprising a compressor (1), an out-door heat exchanger (3), an in-door heat exchanger (7), a four-way change-over valve (2) and a parallel expanding valve device (14), wherein the parallel expanding valve device (14) is connected with the in-door and the out-door heat exchanger (7, 3), characterized in that said parallel valve expanding device (14) comprises a combination of a two-position three-way electromagnetic valve (4) or two one-way valves (9, 10) with opposite leading direction and two groups of parallel expansion valve devices (11,12), in the case of providing with two one-way valves (9, 10) with opposite leading direction, one end of one-way valves (9, 10) being connected directly with said out-door heat exchanger (3) respectively, while the other ends of the one-way valves (9, 10) being connected respectively with said two groups of parallel expansion valves (11, 12), in the case of providing with two-position three-way electromagnetic valve (4), one end of the two-position three-way electromagnetic valve, of which the direction of inlet and outlet could be changed, being connected with the out-door heat exchanger (3) directly, while the other two ends of the three-way electromagnetic valve (4) being connected respectively with two groups of parallel expansion valves (11, 12).

6. The air-conditioner with both cooling and warming functions according to claim 5, wherein each of two groups of expanding valves in the parallel expanding valve device (14) is formed by one expansion valve or a plurality of expansion valves connected in series.

7. The air-conditioner with both cooling and warming functions according to claim 6, wherein thermal engineering device such as gas-liquid separator, oil-liquid separator may be connected in series between respective series expansion valves.

8. An air-conditioner with both cooling and warming functions, comprising a compressor (1), an out-door heat exchanger (3), an in-door heat exchanger (7), a four-way change-over valve (2) and a combination (15) of parallel capillary tube and expansion valve, wherein the combination (15) of parallel capillary tube and expanding valve is connected with in-door and out-door heat exchanger (7, 3), characterized in that said device combination (15) of parallel capillary tube and expansion valve comprises a two-position three-way electromagnetic valve (4) or two one-way valves (9, 10) with opposite leading direction and the combination of a group of parallel capillary tube and a group of expanding valve, in the case of providing with two one-way valves (9, 10) with opposite leading direction, one end of one-way valves (9, 10) being connected directly with said out-door heat exchanger (3) respectively, while the other ends of the one-way valves (9, 10) being connected with a group of parallel capillary tube (5) and a group of expanding valve (12) respectively, in the case of providing with two-position three-way electromagnetic valve (4), one end of two-position three-way electromagnetic valve (4), of which the direction of inlet and outlet could be changed being connected with said out-door heat exchanger (3) directly, while the other two ends of the three-way electromagnetic valve (4) being connected with a group of parallel capillary tube (5) and a group of expansion valve (12) respectively.

9. The air-conditioner with cooling and warming functions according to claim 8, wherein thermal engineering device such as gas-liquid separator, oil-liquid separator may be connected in series between respective series capillary tube and expansion valve.

10. The air-conditioner with both cooling and warming functions according to claim 8, wherein the number of said capillary tube in the combination (15) of parallel capillary tube (5) and expansion valve (12) is of one or more, and the number of said expanding valve is of one or more.

11. An air-conditioner with both cooling and warming functions, comprising a compressor (1), an out-door heat exchanger (3), an in-door heat exchanger (7), a four-way change-over valve (2) and a combination (15) of parallel capillary tube and expansion valve, wherein the combination (15) of parallel capillary tube and expanding valve is connected with the in-door and the out-door heat exchanger (7, 3), characterized in that said combination (15) of parallel capillary tube and expansion valve comprises a two-position three-way electromagnetic valve (4) or two one-way valves (9, 10) with opposite direction of leading through and a combination of two groups of parallel series capillary tube (5) and expansion valve (12), in case of providing with two one-way valves (9, 10) with opposite direction of leading through, one end of the one-way valves (9, 10) being connected directly with the out-door heat exchanger (3) respectively, while the other ends of the one-way valve (9, 10) being connected with the combination of parallel two groups of series capillary tube (5) and expansion valve (12), in case of providing with two-position three-way electromagnetic valve (4), one end of the electromagnetic valve (4), of which the direction of inlet and outlet could be changed being connected with the out-door heat exchanger (3) directly, while the other two ends of three-way electromagnetic valve (4) being connected with said combination of two groups of series capillary tube (5) and expansion valve (12).

12. The air-conditioner with both cooling and warming functions according to claim 11, wherein thermal engineering device such as gas-liquid separator, oil-liquid separator may be connected in series between said respective series capillary tube and expanding valve.

13. The air-conditioner with both cooling and warming functions according to claim 11, wherein in said combination of series capillary tube (5) and expanding valve (12) the number of said capillary tube (5) may be of one or more, and the number of said expanding valve (12) may be of one or more.

* * * * *